US007836626B2

(12) United States Patent
Shepherd

(10) Patent No.: US 7,836,626 B2
(45) Date of Patent: Nov. 23, 2010

(54) TELESCOPIC GUN SIGHT WINDAGE CORRECTION SYSTEM

(76) Inventor: Daniel R. Shepherd, R.R. #1, P.O. Box 189, Waterloo, NE (US) 68069

( * ) Notice: Subject to any disclaimer, the term of this patent is extended or adjusted under 35 U.S.C. 154(b) by 255 days.

(21) Appl. No.: 11/713,308

(22) Filed: Feb. 28, 2007

(65) Prior Publication Data

US 2008/0202011 A1 Aug. 28, 2008

(51) Int. Cl.
*F41G 1/38* (2006.01)

(52) U.S. Cl. ..... 42/130; 42/119; 42/122; 89/41.19

(58) Field of Classification Search ..... 42/111, 42/119, 122, 130; 89/41.19
See application file for complete search history.

(56) References Cited

U.S. PATENT DOCUMENTS

| | | | | |
|---|---|---|---|---|
| 2,094,623 | A | 10/1937 | Stokey | |
| 2,955,512 | A | 10/1960 | Kollmorgen et al. | |
| 3,392,450 | A | 7/1968 | Herter et al. | |
| 4,403,421 | A | 9/1983 | Shepherd | |
| 4,584,776 | A | 4/1986 | Shepherd | |
| D306,173 | S * | 2/1990 | Reese | D16/130 |
| D397,704 | S * | 9/1998 | Reese | D16/130 |
| 5,920,995 | A * | 7/1999 | Sammut | 42/122 |
| 6,681,512 | B2 * | 1/2004 | Sammut | 42/122 |
| 7,171,775 | B1 * | 2/2007 | Lacorte | 42/122 |
| 7,185,455 | B2 * | 3/2007 | Zaderey | 42/122 |
| 7,343,707 | B2 * | 3/2008 | Smith, III | 42/122 |
| 7,411,750 | B2 * | 8/2008 | Pai | 359/822 |
| 7,434,345 | B2 * | 10/2008 | Verdugo | 42/130 |
| 2007/0022651 | A1 * | 2/2007 | Verdugo | 42/130 |
| 2007/0044364 | A1 * | 3/2007 | Sammut et al. | 42/122 |

* cited by examiner

*Primary Examiner*—Bret Hayes
*Assistant Examiner*—Michael D David
(74) *Attorney, Agent, or Firm*—Stinson Morrison Hecker LLP

(57) ABSTRACT

An improved telescopic gun sight includes a telescopic gun sight at least including an adjustable lens configuration for adjustably magnifying an external object to form an object image, an inverting tube for inverting the object image, an ocular lens array for presenting the object image for viewing, a primary reticule including sighting insignia imprinted thereon and a secondary reticule being movable both horizontally and vertically in the image plane. The secondary reticule includes a generally horizontal windage correction scale operative to provide instant windage correction target alignment. It includes instant windage correction target alignment values positioned at point-specific spaced-apart locations with specific instant windage correction target alignment values corresponding to selected distance amounts calculated for a selected bullet type and weight.

8 Claims, 4 Drawing Sheets

TELESCOPIC GUN SIGHT WINDAGE CORRECTION SYSTEM

BACKGROUND OF THE INVENTION

1. Technical Field

The present invention relates to improvements in telescopic gun sights and, more particularly, to an improved windage correction system for a telescopic gun sight which includes a generally horizontal windage correction scale operative to provide instant windage correction target alignment and including instant windage correction target alignment values positioned at point-specific spaced-apart locations on the generally horizontal scale with specific instant windage correction target alignment values corresponding to selected distance amounts calculated for a selected bullet type and weight.

2. Description of the Prior Art

Present telescopic sites used on rifles and other firearms, generally comprise a cross-hair reticule positioned within the scope for referencing the hunter's vision with respect to a target. A hunter "sights in" or "zeros" the scope by firing bullets in a trial-by-error method and repetitively adjusts the reticule in the scope until the center of the cross-hair of the reticule aligns with the impact position of the bullet on the target. Such a method of zeroing a rifle requires considerable time and the costly firing of bullets.

U.S. Pat. No. 2,094,623 issued to F. E. Stokey in 1937, discloses a telescopic sight in which two reticules are utilized to enable the rifle to be zeroed in with a single shot. The Stokey device, however, was quite expensive and complicated. Also, because the hunter always views two reticules within his field of vision through the scope, it was quite possible that the hunter would inadvertently sight on the incorrect reticle. Also, the reticule which was sited in on target, could be off center from the field of vision through the scope causing further confusion and irritation to the hunter. Further, the hunter was shooting upside down with the Stokey scope, because the image through the scope was inverted due to the use of an objective and an ocular lens.

While the Stokey scope of 1937 suggested one-shot sighting, the inherent disadvantages, expense and complication of the system voided its general use. Since 1937, the prior art has suggested the use of an inverting tube to erect the object to be viewed through the scope by the hunter thus, eliminating upside down shooting by the hunter. The use of an inverting tube further establishes the center of the cross-hair wires at the center of the scope's field of vision despite adjustment of the cross-hair reticule relative to the image being viewed. The advent of the inverting tube was thus well received by the hunter.

When using an inverting tube within a scope, the reticule is positioned at the eye piece end of the tube. This is because the positioning of the reticule at the object end of the inverting tube causes the magnification of the cross-hairs of the reticule at high powers of the scope, particularly where the scope has zoom capabilities for changing the object's magnification. Such magnification of the cross-hair wires is annoying to the hunter, blocking portions of his view. Thus, present day scope manufacturers utilize an inverting tube with cross hair wires positioned at the eye piece end of the inverting tube.

Besides the problem of multiple firings to sight-in present day scopes, a problem of parallax exists when using the scope to shoot at close range. Parallax is caused by the cross-hair wires lying outside the image plane in conjunction with the hunter varying the position of his eye relative to the scope as he does not each time look across the cross-hairs at the same visual angle.

Further problems with such conventional scopes include the addition of devices which serve to approximate range and determine the "hold over" or aiming point in view of the range of the target. Particularly, the rifleman must judge the distance of the object and then compensate for the drop of the bullet in view of the weight and velocity of the bullet. Thus, the hunter must point the scope above the target in order for the bullet to drop onto the target. All of these range finding devices, however, add clutter to the hunter's field of vision and are particularly annoying when the hunter is shooting at close range and thus not using the range finding devices.

Such range finding devices include, for example, the use of a transparent reticule disc at one end of an inverter tube, which bears separate circles for denoting range and drop of the bullet, see for example U.S. Pat. No. 3,392,450 issued to G. L. Herter et al. on Jul. 16, 1968 or Shepherd, U.S. Pat. No. 4,403,421, issued on Sep. 13, 1983. Other such range defining devices include stadia lines which take the form of two parallely disposed horizontal lines positioned across the field of view of the hunter for his use to determine whether the object fits within the lines in order to gauge distance of a targeted object. However, despite the various types of range finding indicia used with scopes of the prior art, there has been precious little development or improvement in the methods and devices available to hunters and shooters to correct for wind, and as wind correction is at least as critical to a successful shot as finding the range to the target, there is a need for significant improvement in this area.

There are several simple formulas available to calculate the deflection due to a crosswind. One which is used in the art is as follows: $z=w*(t-X/v_0)$ where z is the deflection, w is the wind speed, t is the flight time of the bullet to the target, x is the distance to target and $v_0$ is the muzzle velocity. This formula is most commonly used with metric units, with velocities in meters per second, time in seconds and distances in meters. The only unknown parameter in the above formula is the bullet flight time (which generally may be found in manufacturers' tables).

Another widely used formula is the United States Marine Corps formula, which is used as follows: After determining wind direction and speed, the following formula is applied: Range in 100 Yds.×Speed in MPH/15 (math constant)=MOA Windage. For instance, if your target is 300 yards away, and there's a 10 MPH wind, you would plug the numbers into the formula like this: 3×10=30/15=2 MOA. Click-in the two minutes of angle into the scope in the direction of the wind and aim dead-on. It should be noted, however, that one additional concern with the Marine formula is that it is only accurate at 500 yards or less. With a target that is farther away, the mathematical constant must change, as shown here: 600 Yards: Divide by 14, 700 Yards: Divide by 13, 800 Yards: Divide by 13, 900 Yards: Divide by 12 and 1,000 Yards: Divide by 11.

To perform all these calculations immediately prior to taking the shot is a difficult task to say the least, and therefore there is a need to improve and streamline the task of determining appropriate windage corrections. It is, therefore, an object of the present invention to provide an improved telescopic sight which adds the advantages of the prior art without their attending disadvantages.

It is yet another object of the invention to provide a telescopic sight which includes an easily used windage correction system and method by which windage corrections for shots may be quickly and accurately determined.

It is yet another object of the present invention to provide a telescopic sight for use with a firearm which includes a secondary reticule having a windage correction scale imprinted thereon which is removed from the field of view in the scope when the magnification of the scope approaches its maximum magnification setting.

It is yet another object of the present invention to provide a telescopic sight having a generally horizontal windage correction scale imprinted on either the primary or secondary reticule, the scale operative to provide instant windage correction target alignment and including instant windage correction target alignment values positioned at point-specific spaced-apart locations on the generally horizontal scale with specific instant windage correction target alignment values corresponding to selected distance amounts calculated for a selected bullet type and weight.

It is yet another object of the present invention to provide a telescopic gun sight with a windage correction scale which requires only minimal computation prior to use, and will not substantially slow or retard the aiming and shooting process.

Finally, an object of the present invention is to provide an improved telescopic sight having a windage correction scale which is relatively simple and durable in construction and is safe, efficient and effective in use.

SUMMARY OF THE INVENTION

The present invention provides a windage correction system for a telescopic gun sight which includes a telescopic gun sight at least including an adjustable lens configuration for adjustably magnifying an external object to form an object image, an inverting tube for inverting the object image, an ocular lens array for presenting the object image for viewing, a primary reticule positioned generally adjacent the ocular lens array rearwards of the inverting tube and including sighting insignia imprinted thereon and a secondary reticule being movable both horizontally and vertically in the image plane independent of the inverting tube and positioned forward of the adjustable lens configuration. The secondary reticule further includes a generally horizontal windage correction scale operative to provide instant windage correction target alignment. It includes instant windage correction target alignment values positioned at point-specific spaced-apart locations on the generally horizontal scale with specific instant windage correction target alignment values corresponding to selected distance amounts calculated for a selected bullet type and weight.

The present invention as thus described provides substantial advantages over those windage correction devices and systems found in the prior art. For example, the windage scale allows a user to quickly and accurately determine the appropriate windage correction value which should be used for the shot. Moreover, this is done without requiring the user to undertake extensive calculations to determine the appropriate windage correction, as the present scale generally eliminates the necessity for such calculations. Finally, although minute of angle windage correction scales have been used for a long time in connection with telescopic gun sights, use of such MOA scales still require substantial calculations to enable them to be used for windage correction, whereas the present invention requires almost no detailed calculations prior to use of the scale. It is therefore seen that the present invention provides a substantial improvement over those methods, systems and devices found in the prior art.

DESCRIPTION OF THE PREFERRED EMBODIMENT

Figure 1:
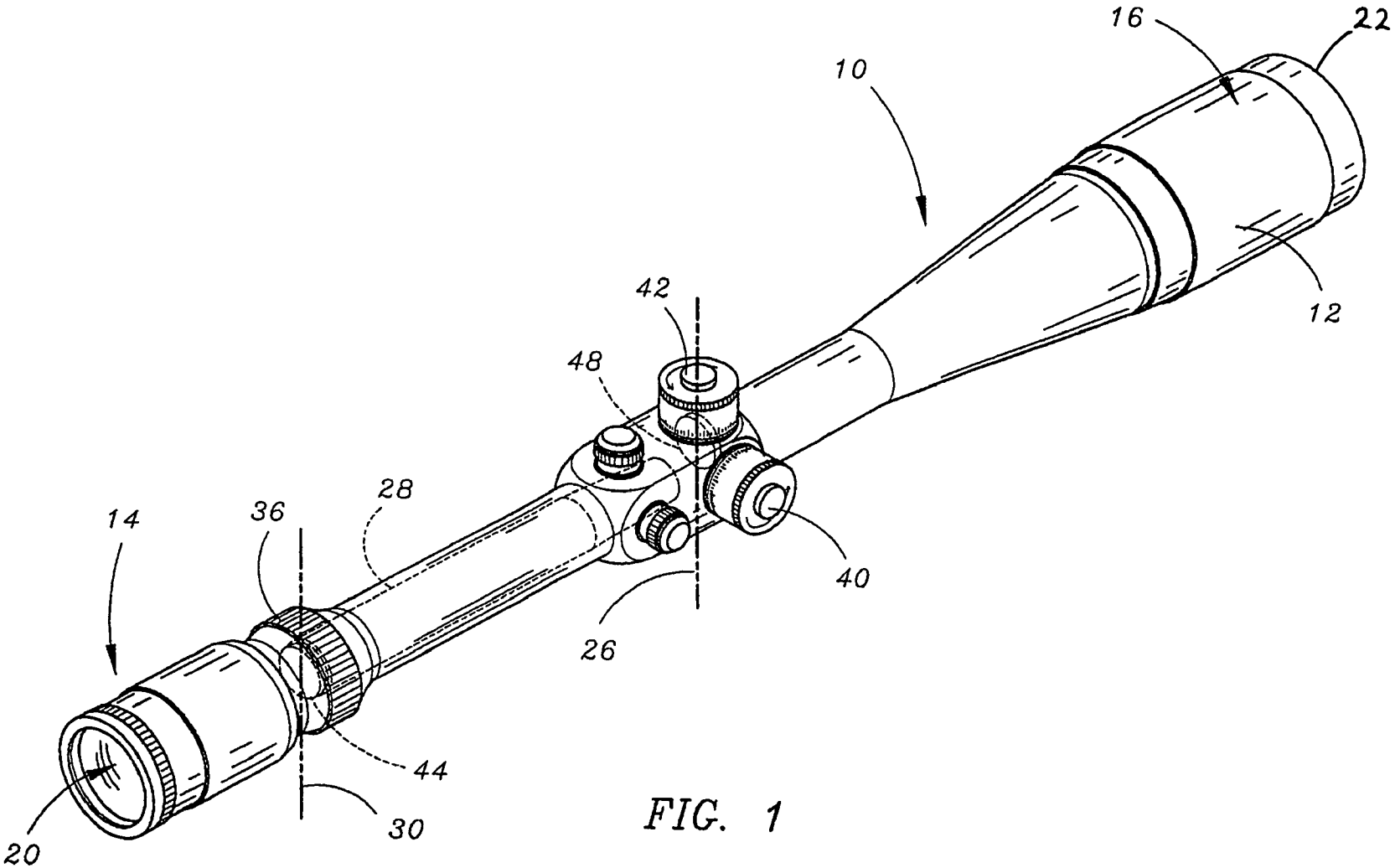
FIG. 1 is a perspective view of the improved telescopic gun sight of the present invention.

Referring to FIG. 1, the improved telescopic gun sight 10 is shown as including a pair of reticule adjustment knobs 40 and 42 disposed along the outside of the tubular housing 12 of the scope 10, for permitting the hunter to selectively adjust the effective position of a pair of sighting reticules disposed within the scope 10, in order to properly sight-in the rifle and correct for bullet drop and any crosswind.

The scope includes an eyepiece end 14 comprising an ocular lens system 20 through which the hunter views during siting of a target upon which he wishes to fire. The other end of the scope is the objective end 16 and includes an objective lens 22 which is directed toward the object to be viewed. The light rays coming from the object pass through objective lens 22 and converge to form an image on an image plane within the tubular housing and generally defined by reference numeral 26. Because the image appearing in the image plane will be the inverted image of the viewed object, an inverter tube 28 is disposed between the image plane 26 and the ocular lens 20 for erecting the image for upright presentation as a second intermediate image in a second image plane generally defined by reference numeral 30. The second image plane lies at the focus of the ocular lens 20 for presenting the erected image to the eye of the hunter, as understood.

The inverter tube 28 includes standard erecting lenses positioned in a conventional fashion for erecting the image received by the inverting tube 28, with the erecting lenses being adjustably mounted relative to one another and are movable via rotational movement of adjustment ring 36. As the adjustment ring 36 is rotated, the erecting lenses are moved in a predetermined relationship in order to vary the magnification of the object image appearing in image plane 30, as understood.

A primary reticule 44 comprising a pair of cross-hair wires is fixed with respect to housing 12 at the ocular end of inverter tube 28. The cross-hair wires of reticule 44 serve as reference lines for siting the weapon by the hunter, and the primary reticle 44 functions as per standard siting reticles currently used in the prior art.

The inverter tube 28 is secured in a substantially fixed relationship with respect to housing 12 at the ocular end of the inverting tube, while the objective end of the inverting tube is movable relative to the walls of tubular housing 12. The inverting tube 28 may be adjusted by any appropriate adjusting device, and such adjustment devices are understood by those skilled in the art of telescopic gun sights. Movement of the objective end of the inverting tube 28 serves to position primary reticule 44 relative to the image plane 26 for positioning the image with respect to the primary reticule as viewed by the hunter. Such inverter tubes have been used previously in scope sights; see for example U.S. Pat. No. 2,995,512 issued to Kollmorgen et al on Oct. 11, 1960.

The use of the inverting tube permits the primary reticule 44 to have the center of the cross-hair wires always in the center of the field of vision of the hunter through scope 10. This is most preferable to the hunter and avoids any confusion caused by the cross hairs being positioned off-centered due to adjustment by the hunter to indicate the center of the scope with respect to the gun barrel. Thus, the line of site of scope 10 is along an optical axis which passes through the eye piece lens system, the inverting tube and the objective lens, and has the center of the cross-hair reticule at the center of the field of vision of the hunter.

A secondary reticule 48 is positionable in image plane 26 for movement therewithin independently of the movement of inverter tube 28. As shown in more detail in FIGS. 2 and 3, secondary reticule 48 is adjustably mounted within the tubular housing 12 such that the secondary reticule depends from a mounting structure into the image plane 26. Reticule adjustment knobs 40 and 42 control the movement of secondary reticule 48 in the horizontal and vertical planes, and in the preferred embodiment, the reticule adjustment knobs 40 and 42 are designed to adjust the position of the secondary reticule 48 through a "click" type of adjustment where each rotational "click" of the reticule adjustment knobs 40 and 42 equates to an adjustment of ¼ MOA (minutes of angle). Of course, it may be preferable to utilize a different adjustment system, but it has been found that the well-known and currently available "click" adjustment system works perfectly well with the present invention and therefore its use herewith is preferred.

At this point, the invention is similar to at least one prior art gunsight, specifically Shepherd, U.S. Pat. No. 4,403,421. However, the significant inventive aspects of the present invention will now be exposed, particularly as they relate to indicia inscribed on or formed on the secondary reticule 48 which, as was discussed previously, would preferably be a generally circular glass or transparent plastic plate. Specifically, the indicia imprinted on the secondary reticule 48 is an improved windage scale 70 which is operative to provide instant windage correction target alignment for a user of the improved telescopic gunsight 10 of the present invention without requiring significant mathematical equation solving as is currently required by windage correction systems and methods found in the prior art.

As was discussed previously, one of the most common wind correction methods currently used in the United States Marine Corps windage correction formula which requires the shooter to determine the range in one hundred yard increments from the shooter and then multiply that number by the wind speed in miles per hour, and then divide the resulting figure by fifteen, which serves as the math constant, to determine the minutes of angle which should be used to correct for the wind value. While this formula is not exceedingly difficult to apply, it has several significant drawbacks, the first being that even after the entire formula is computed, the user must then "click in" the resulting minutes of angle into the scope in order to correct for the wind, and the shooter must be sure that the clicks have been applied in the correct direction, namely in the direction of the wind. Furthermore, the USMC formula is only accurate at five hundred yards or less and, when the target is farther away, the mathematical constant must be changed, as was described previously. The shooter must be aware of all of these variations and calculations, compute all of them to a sufficient degree of accuracy, apply the resulting minutes of angle to the scope, ensure that the scope is being adjusted in the correct direction, and then and only then may he or she commence with the shot. In field operations, the maximum amount of time permitted by armed forces regulations to complete the computations and correctly adjust the scope for range and windage is four minutes, and it is clear that in that time period, many other events may have occurred, and in fact the opportunity to take the shot may have been lost forever.

The improved windage scale 70 of the present invention seeks to avoid all of those computations by providing a simple to use and direct windage correction scale which does not require the user to undertake significant mathematical operations to determine the correct windage adjustment. In the present invention, the improved windage scale 70 would include instant windage correction target alignment values 72 which would be printed above the standard minutes of angle scale 66, as shown best in FIGS. 2 and 3. In the preferred embodiment, the instant windage correction target alignment values 72 would consist of a series of integer values beginning with the number three and proceeding up to the number ten, with each numerical integer value being associated with a point-specific location signified by a dot 74, with one set of instant windage correction target alignment values 72 positioned on each side of the secondary reticule 48 to provide correction for winds blowing from either direction across the shooter's line of fire. As each of the instant windage correction target alignment values 72 are identical, the following description of the left set should be understood to apply equally to the right set of values.

The positions of the dots 74 are determined by selecting corresponding distance amounts to correspond with the integer values positioned above the dot 74. In the preferred embodiment, the integer values would correspond with the hundred yard range of the shot to be taken, with the first integer value being three thus corresponding to three hundred yards and the last integer value being ten and corresponding to the thousand yard windage correction location. Each of the dots 74 are positioned at the correct minutes of angle locations to indicate where a fifty-five gram HORNADY®, VMAX bullet propelled at a muzzle velocity of 3240 FPS would be pushed by a full value ten mile per hour wind blowing directly from left to right across the shooter's line of fire. To clarify, a full value wind is from the nine o'clock or three o'clock direction which corresponds to a ninety degree angle from the shooter's line of fire toward the target, which is always considered twelve o'clock. A wind from a direction of one-thirty, four-thirty, seven-thirty, or ten-thirty would be a half value wind, which would move the bullet off course approximately half as much as the same wind would if it were a full value. Likewise, a one-third value wind will move it one-third of the amount and a two-thirds value wind will push it two-thirds and so on and so forth. Winds blowing directly towards or directly away from the shooter have no crosswind value and correction for these types of winds is not necessary using the improved windage scale 70 of the present invention.

Returning to the improved windage scale 70 of the present invention, it should be noted that the ten mile per hour figure used to design the improved windage scale 70 is a very versatile choice in that it is easy to convert this scale to other wind speeds regardless of the value of those wind speeds. For example, if the shooter were to encounter a five mile per hour wind, the improved windage scale 70 would be used with half the values in the scale, and likewise for a fifteen mile per hour wind, a shooter would use one point five times the value shown on the scale. The main problem in correctly determining the appropriate wind correction factor, however, is to obtain an accurate determination of the speed and direction of the wind, and therefore it is generally recommended to use a portable, hand-held anemometer to make such determinations. However, the benefit of the present invention is that once the wind speed and direction are determined, the user of the present invention will need to make only minor calculations and adjustments to properly institute the windage correction using the improved telescopic gunsight 10 of the present invention.

Figure 7:
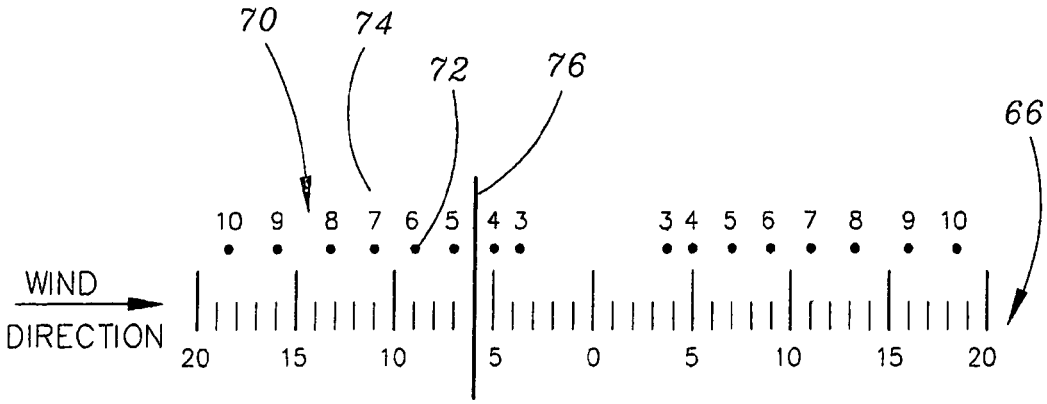
FIGS. 7, 8 and 9 are detailed scope views showing the windage correction scale of the present invention being used for windage correction.
Figure 8:
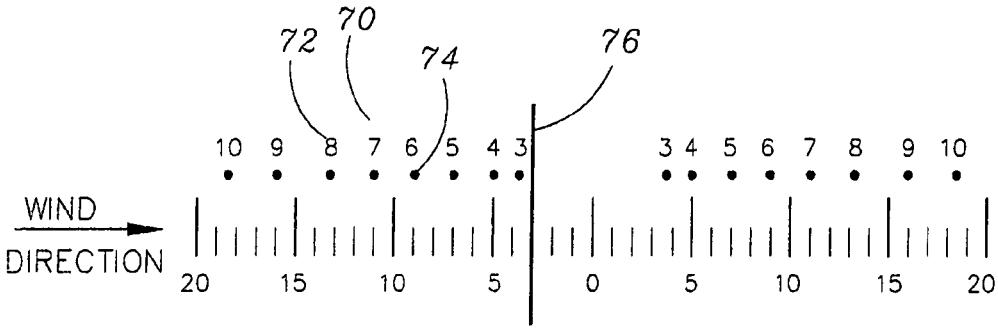

For example, say the user determines that a twenty mile per hour wind was blowing from the one-thirty direction during preparation for the shot. As was discussed previously, the one-thirty wind would be a half value wind and when multiplied by the twenty mile per hour wind speed, the resulting affecting speed of the wind is ten miles per hour. This is exactly the scale at which the improved windage scale 70 of the present invention is set, and so once the shooter has determined the distance of the shot, for example four hundred fifty yards. as shown in FIG. 7, he or she would then "click in" the adjustment by rotating reticule adjustment knob 40 to move the windage scale 70 to the right until the windage adjustment line 76 is positioned in alignment with the dot 74 corresponding to the value halfway between the four and five on the improved windage scale 72. The shooter would then merely line up the cross hairs on the target and take the shot when ready knowing that the appropriate correction for windage has already been programmed into the improved telescopic gunsight 10 of the present invention. The same procedure may be used with any wind direction and wind speed, such as the five mile per hour wind as shown in FIG. 8, and the need to determine the minutes of angle which need to be set in the scope is eliminated by the improved windage scale 70 of the present invention.

It is also a relatively simple matter to prepare an alternative windage scale by using a different bullet as the basis for the windage correction target alignment values 72 to be inserted into the improved windage scale 70 of the present invention. This would involve repositioning of the dots 74 once those computations had been completed, but once the dots 74 are positioned in correct association with the instant windage correction target alignment values 72 as reprogrammed and redetermined in connection with a newly-selected bullet type and weight, the user of the improved telescopic gunsight 10 of the present invention may undertake the same quick and simple to perform steps described previously which are now used with the newly-selected bullet type and weight.

Figure 2:
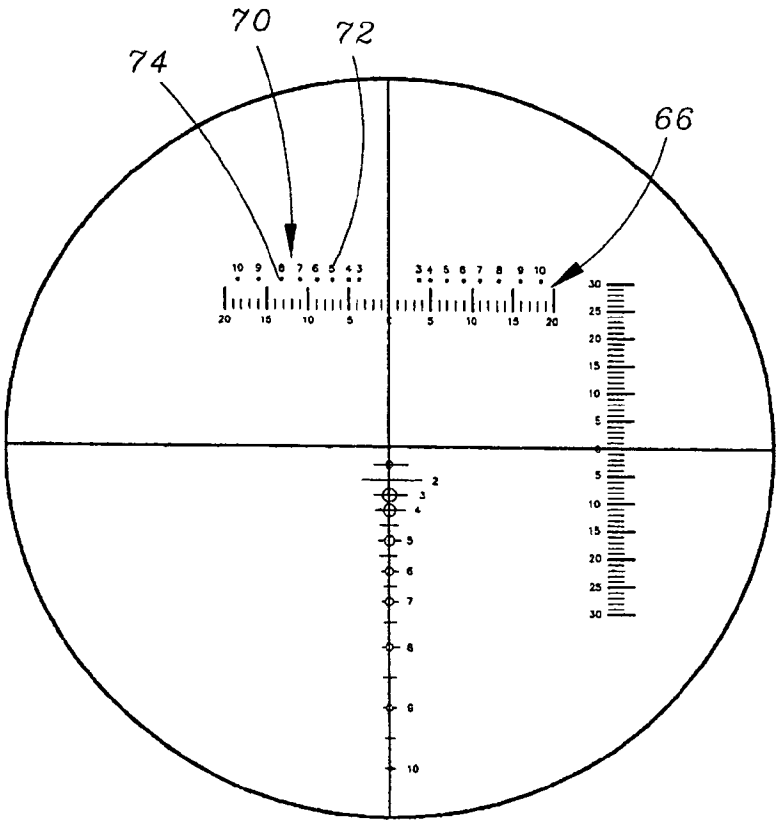
FIG. 2 is a detailed view of the view through the scope showing the indicia imprinted on the primary and secondary reticules.
Figure 3:
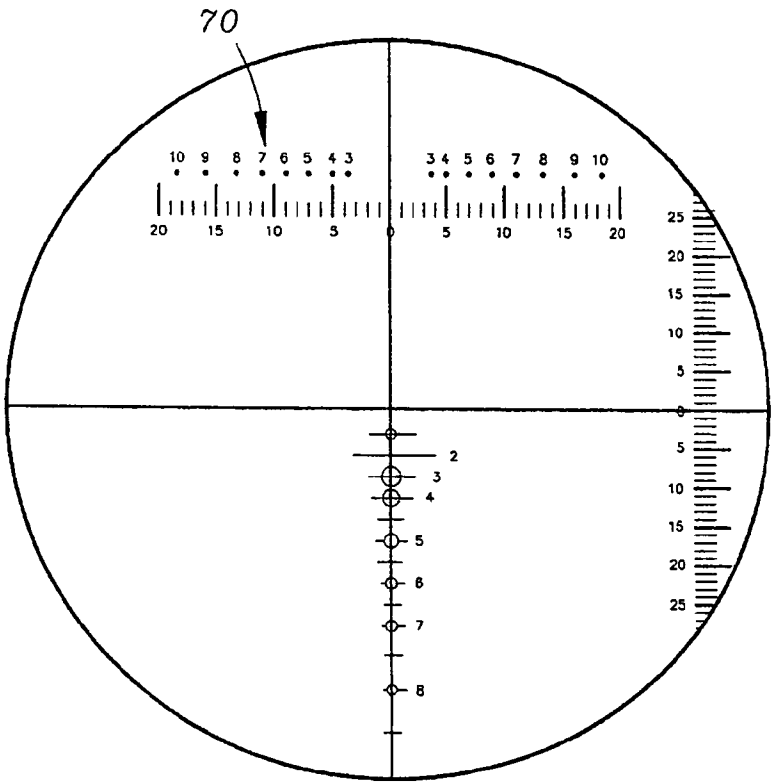
FIG. 3 is a detailed view of the view through the scope at a higher magnification power showing how the indicia are shifted out of the line of sight of fire of the rifle as the magnification is increased.
Figure 5:
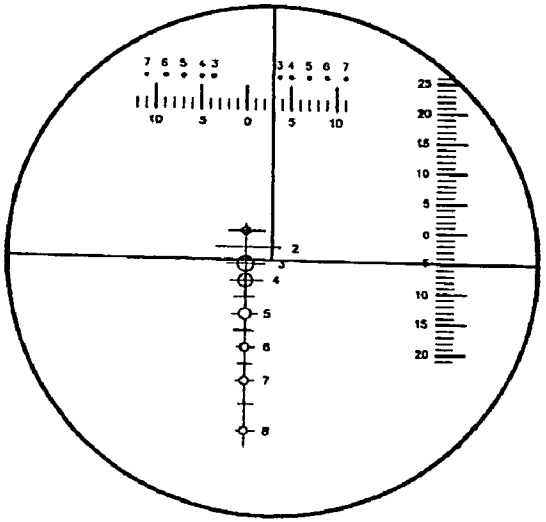
FIGS. 4, 5 and 6 are detailed scope views showing usage of the scope during windage correction.
Figure 6:
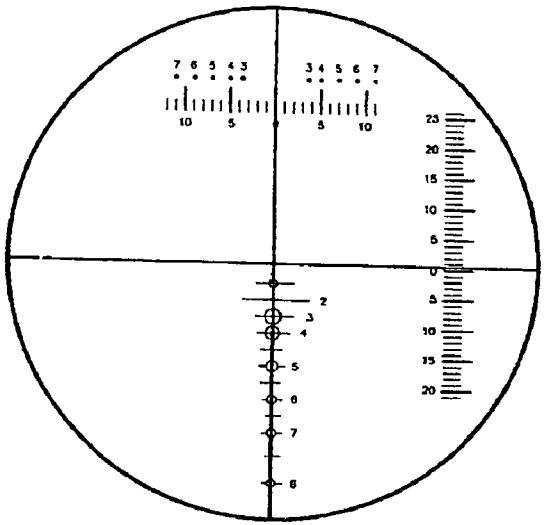
Figure 4:
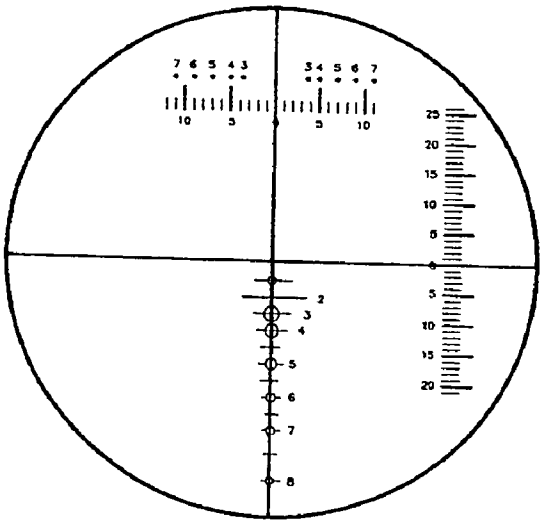

One of the true benefits of the improved windage scale 70 of the present invention is shown best in FIGS. 2 and 3 in that as the magnification of the target is increased, the viewing field of the gunsight correspondingly grows smaller. Because the improved windage scale 70 is positioned on the secondary reticule 48, this means that as the power of the scope is increased by rotation of the ring 43, the improved windage scale 70 is slowly removed from the field of view, as shown in FIG. 3, and as the magnification of the scope increases towards maximum power, the improved windage scale 70 is no longer visible nor viewable through the improved telescopic gunsight 10. It should be noted that the improved windage scale 70 is of course still imprinted on the secondary reticule 48 but since the viewing field has decreased as the magnification of the scope has been increased, the portion of the secondary reticule 48 which is viewable through the scope no longer includes the improved windage scale 70, and thus the viewing field of the scope is less cluttered which will likely improve the usability of the gunsight 10 with the improved visual field available to the shooter.

Of course, it is not strictly necessary to position the improved windage scale 70 on the secondary reticule 48 in such a manner as to preclude viewing of the improved windage scale 70 as the scope approaches maximum power, but it has been found that the less cluttered the view field of the scope, the greater chance that the shooter will not be distracted in attempting to hit the target. It is only because the improved windage scale 70 is imprinted on the secondary reticule 48 that the above-described feature is even available, and the combination of the features of the improved windage scale 70 as described previously with the removal of the improved windage scale 70 from the viewing field at maximum power renders the present invention a substantial improvement over those windage correction systems and methods found in the prior art.

Figure 9:
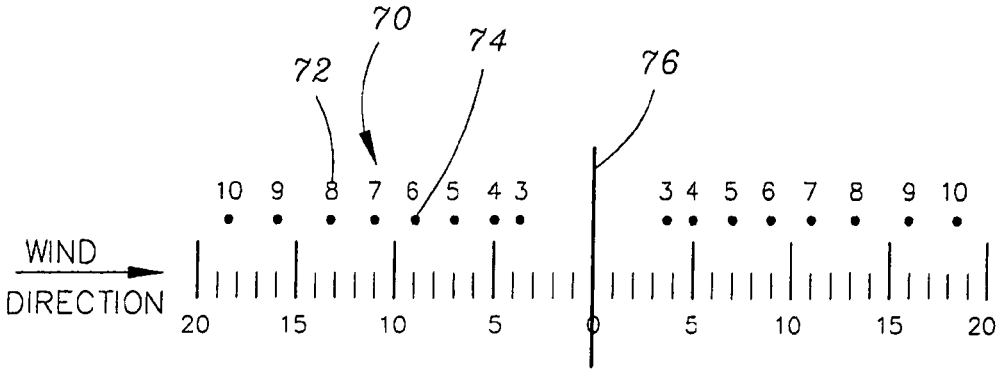

It is to be understood that numerous additions, substitutions and modifications may be made to the improved telescopic gunsight 10 and improved windage scale 70 of the present invention which fall within the intended broad scope of the appended claims. For example, although the improved windage scale 70 has been described as being imprinted on the secondary reticule 48, it may be entirely possible to print the improved windage scale 70 on a primary reticule which is found in numerous gun sights and gun scopes presently available in the prior art, and although the loss of the above-describe feature of having the improved windage scale 70 be removed from view at higher magnifications would be lost when the present invention is used in connection with single reticule scope, the instant windage adjustment features previously described will still be available and these are believed to be extremely valuable and deserving of protection regardless of the positioning of the improved windage scale 70 on any particular primary or secondary reticule. Furthermore, although the improved windage scale 70 has been described as being used with particular integer values to represent yardage of the shot, adjustment or modification of the integer or numeric values may be easily done by substituting any particular alphanumeric or symbolic value for the instant windage correction target alignment values 72 used in connection with the positioning dots 74 as described previously. For example, a shooter who consistently shoots at one particular type of target positioned a specific distance away, such as a biathelete or target shooting participant, could place a positioning dot 74 at the appropriate distance and label that particular location with a selected alphanumeric value which has significance to that particular person. Modification and substitution of such alphanumeric values is therefore understood to be a part of this disclosure. Finally, it should be noted that although use of the improved windage scale 70 has been described as including the step of clicking the scope adjustment device to move the secondary reticule 48 to the appropriate alignment with the windage adjustment line 76, with practice it may be more efficient for the user to simply offset the shot alignment to move the target into line with the appropriate windage correction target alignment value 72 instead of adjusting the secondary reticule 48, which takes longer to institute, as shown in FIG. 9. It is expected that with sufficient practice, such offset aiming will likely be as accurate as adjustment of the scope, but it has been found that adjustment of the scope by use of the improved windage scale 70 of the present invention results in the most accurate and most dependable windage adjustment currently available, and therefore it is preferred that each of the steps described previously be performed in sequence to correct for wind by use of the improved windage scale 70 of the present invention.

There has therefore been shown and described an improved telescopic gunsight 10 and improved windage scale 70 which accomplish at least all of their intended objectives.

I claim:

1. A telescopic gun sight for sighting an image of an object, comprising:

a housing comprising an objective end and an eyepiece end;

an objective lens positioned within said objective end, said objective lens operable to receive light from the object and focus the image of the object at an image plane positioned between said objective and eyepiece ends;

an inverting tube positioned between said image plane and said eyepiece end for inverting the object image;

an ocular lens positioned within said eyepiece end for presenting the inverted object image for viewing;

a primary reticule positioned between said ocular lens and said inverting tube, said primary reticule including sighting insignia imprinted thereon; and a secondary reticule positioned between said inverting tube and said objective lens, said secondary reticule being movable both horizontally and vertically in said image plane independent of said inverting tube, said secondary reticule comprising a generally horizontal windage correction scale operative to provide instant windage correction target alignment, said windage correction scale comprising a plurality of instant windage correction target alignment values positioned at point-specific spaced-apart locations on said windage correction scale, wherein each instant windage correction target alignment value corresponds with a selected distance calculated for a selected bullet type, bullet weight, and wind speed, said windage correction scale eliminating the need to calculate the horizontal deflection of a bullet due to wind and the minutes of angle corresponding to the horizontal deflection.

2. The telescopic gun sight of claim 1 wherein said inverting tube further comprises a plurality of adjustable lenses operable to magnify the object image up to a maximum magnification power, and wherein said generally horizontal windage correction scale is imprinted on said secondary reticule in a position such that when said adjustable lenses magnify the object image to the maximum magnification power said generally horizontal windage correction scale is no longer visible through said ocular lens.

3. The telescopic gun sight of claim 1 wherein said instant windage correction target alignment values are integer values selected to correspond to the distance from said housing to the object image in one of meters and yards divided by one hundred.

4. The telescopic gun sight of claim 1 wherein said generally horizontal windage correction scale further comprises a series of marks positioned at said point-specific spaced-apart locations to clearly delineate said point-specific spaced-apart locations each of which corresponds to a selected distance calculated for a selected bullet type, bullet weight, and wind speed.

5. The telescopic gun sight of claim 4, wherein said marks comprise dots.

6. A reticule, comprising:

a generally horizontal windage correction scale operative to provide instant windage correction target alignment, said windage correction scale comprising a plurality of instant windage correction target alignment values positioned at point-specific spaced-apart locations on said windage correction scale, wherein each instant windage correction target alignment value corresponds with a selected distance calculated for a selected bullet type, bullet weight, and wind speed, said windage correction scale eliminating the need to calculate the horizontal deflection of a bullet due to wind and the minutes of angle corresponding to the horizontal deflection.

7. The reticule of claim 6, wherein said reticule is configured for use in a telescopic gun sight operable to sight an object image, and wherein said instant windage correction target alignment values are integer values selected to correspond to the distance from the gun sight to the object image in one of meters and yards divided by one hundred.

8. The reticule of claim 6, wherein said generally horizontal windage correction scale further comprises a series of marks positioned at said point-specific spaced-apart locations to clearly delineate said point-specific spaced-apart locations each of which corresponds to a selected distance calculated for a selected bullet type, bullet weight, and wind speed.

* * * * *